US008056624B2

(12) United States Patent
Gates et al.

(10) Patent No.: US 8,056,624 B2
(45) Date of Patent: Nov. 15, 2011

(54) IN SITU HEAVY OIL AND BITUMEN RECOVERY PROCESS

(75) Inventors: Ian Donald Gates, Calgary (CA); Stephen Richard Larter, Calgary (CA); Jennifer Jane Adams, Calgary (CA)

(73) Assignee: UTI Limited Partnership, Calgary, CA (US)

( * ) Notice: Subject to any disclaimer, the term of this patent is extended or adjusted under 35 U.S.C. 154(b) by 195 days.

(21) Appl. No.: 12/374,927

(22) PCT Filed: Jul. 19, 2007

(86) PCT No.: PCT/CA2007/001216

§ 371 (c)(1), (2), (4) Date: Jan. 23, 2009

(87) PCT Pub. No.: WO2008/011704

PCT Pub. Date: Jan. 31, 2008

(65) Prior Publication Data

US 2010/0065268 A1 Mar. 18, 2010

Related U.S. Application Data

(60) Provisional application No. 60/820,129, filed on Jul. 24, 2006, provisional application No. 60/895,869, filed on Mar. 20, 2007.

(51) Int. Cl.
*E21B 43/24* (2006.01)
*E21B 43/243* (2006.01)
*E21B 47/06* (2006.01)

(52) U.S. Cl. .... 166/251.1; 166/50; 166/52; 166/250.01; 166/252.1; 166/256; 166/263; 166/272.1; 166/272.3; 166/272.7; 166/384

(58) Field of Classification Search ..... 166/50, 166/251, 272.7, 251.1, 52, 245, 250.01, 250.07, 166/252.1, 256, 263, 272.1, 272.3, 306, 373, 166/384

See application file for complete search history.

(56) References Cited

U.S. PATENT DOCUMENTS 1,660,187 A * 2/1928 Adolf ..... 299/2

(Continued)

OTHER PUBLICATIONS

Butler et al., "Natural and gas-lift in SAGD production wells," *Journal of Canadian Petroleum Technology*, 39(1):18-29, 2000.

(Continued)

*Primary Examiner* — George Suchfield
(74) *Attorney, Agent, or Firm* — Fulbright & Jaworski

(57) ABSTRACT

The present invention is directed to an in situ reservoir recovery process that uses a horizontal well located near the top of a reservoir and an inclined production well to extract bitumen or heavy oil from a reservoir. In a first stage, the top well is used for cold production of reservoir fluids to the surface, in which, reservoir fluids are pumped to the surface in the absence of stimulation by steam or other thermal and/or solvent injection. A lower production well is drilled into the formation below the top well. The top well is converted to an injection well or, if no cold production then a top well is drilled as an injector well. A portion of the bottom well is inclined so that one end of the incline is closer to the injector well than the other end of the incline. In the process, steam circulation creates a heated zone at the point of the two wells that are closest together in the reservoir.

54 Claims, 17 Drawing Sheets

U.S. PATENT DOCUMENTS

| | | | | | |
|---|---|---|---|---|---|
| 3,692,110 | A | * | 9/1972 | Grady | 166/245 |
| 4,022,279 | A | * | 5/1977 | Driver | 166/271 |
| 4,099,783 | A | * | 7/1978 | Verty et al. | 299/2 |
| 4,248,302 | A | | 2/1981 | Churchman | 166/272.1 |
| 4,344,485 | A | | 8/1982 | Butler | 166/271 |
| 4,646,836 | A | * | 3/1987 | Goodhart | 166/303 |
| 4,942,926 | A | * | 7/1990 | Lessi | 166/385 |
| 4,945,994 | A | * | 8/1990 | Stagg | 166/369 |
| 5,016,709 | A | | 5/1991 | Combe et al. | 166/245 |
| 5,215,146 | A | * | 6/1993 | Sanchez | 166/272.3 |
| 5,318,124 | A | | 6/1994 | Ong et al. | 166/272.3 |
| 5,462,118 | A | * | 10/1995 | Jennings et al. | 166/312 |
| 5,511,616 | A | * | 4/1996 | Bert | 166/272.7 |
| 6,050,335 | A | * | 4/2000 | Parsons | 166/272.3 |
| 6,167,966 | B1 | | 1/2001 | Ayasse et al. | 166/268 |
| 6,257,334 | B1 | * | 7/2001 | Cyr et al. | 166/272.7 |
| 6,708,759 | B2 | * | 3/2004 | Leaute et al. | 166/272.4 |
| 2002/0020533 | A1 | * | 2/2002 | Tubel | 166/313 |
| 2005/0087340 | A1 | * | 4/2005 | Zupanick et al. | 166/245 |
| 2005/0211434 | A1 | * | 9/2005 | Gates et al. | 166/272.3 |
| 2006/0042794 | A1 | * | 3/2006 | Pfefferle | 166/272.7 |

OTHER PUBLICATIONS

Donnelly, "The best process for Cold Lake CSS versus SAGD," Paper 99-26, presented at the 1999 CSPG and Petroleum Society Convention, Calgary, Alberta, Canada, Jun. 14-18, 1999.

Gates et al., "Optimization of steam-assisted gravity drainage in McMurray Reservoir," Paper 2005-193 presented at Canadian International Petroleum Conference, Calgary, Alberta, Canada, Jun. 7-9, 2005.

Gates et al., "Steam injection strategy and energetics of steam-assisted gravity drainage," Paper SPE 97742 presented at the 2005 SPE International Thermal Operations and Heavy Oil symposium, held in Calgary, Alberta, Canada, Nov. 103, 2005.

Head et al., "Biological activity in the deep subsurface and the origin of heavy oil," *Nature*, 426(6964):344-352, 2003.

Huang et al., "A dynamic biodegradation model suggested by petroleum compositional gradients within reservoir columns from the Liaohe basin, NE China," *Organic Chemistry*, 35:299-316, 2004.

Komery et al., "Pilot testing of post-steam bitumen recovery from mature SAGD wells in Canada," *Seventh UNITAR International Conference*, Paper No. 1998.214, Beijing, China, 1998.

Koopmans et al., "Biodegradation and mixing of crude oils in Eocene Es3 reservoirs of the Liaohe basin, northeastern China," *AAG Bulletin*, 86(10):1833-1843, 2002.

Larter et al., "The controls on the composition of biodegraded oils in the deep subsurface—part 1: biodegradation rates in petroleum reservoirs," *Organic Geochemistry*, 34:601-613, 2003.

Larter et al., "The origin, prediction and impact of oil viscosity heterogeneity on the production characteristics of tar sand and heavy oil reservoirs," Paper 2006-134 presented at the Petroleum Society's 7$^{th}$ Canadian International Petroleum Conference, Calgary, Alberta, Canada, Jun. 13-15, 2006.

Saltukaroglu et al., "Mobil's SAGD experience at Celtic, Saskatchewan," *The Petroleum Society*, Paper 99-25, 1999.

* cited by examiner

IN SITU HEAVY OIL AND BITUMEN RECOVERY PROCESS

The present application is a national phase application under 35 U.S.C. §371 of International Application No. PCT/CA2007/001216 filed Jul. 19, 2007 which claims benefit of priority to U.S. Provisional Application Ser. No. 60/820,129 filed Jul. 24, 2006 and U.S. Provisional Application Ser. No. 60/895,869 filed Mar. 20, 2007. The entire contents of each of the above-referenced disclosures is hereby incorporated by reference.

TECHNICAL FIELD

The present invention relates to processes for the recover of heavy oil and bitumen, in particular the use of an inclined portion of a production well within a gravity assisted drainage process.

BACKGROUND

There are several commercial recovery technologies that are currently used to recover in situ heavy oil or bitumen from tar sands reservoirs. In current practice, in situ technologies are used to recover heavy oil or bitumen from deposits that are buried more deeply than about 70 m below which it is no longer economic to obtain hydrocarbon by current surface mining technologies. Most commercial in situ processes can recover between about 10 and 60% of the original hydrocarbon in place depending on the operating conditions of the in situ process and the geology of the heavy oil or bitumen reservoir. The impact of variations of oil phase viscosity has been demonstrated by using detailed and advanced reservoir simulation. In addition to permeability, porosity, and oil saturation heterogeneity, oil phase viscosity variations add another complicating and sometimes process dominating feature for producing heavy oil and bitumen reservoirs.

The Steam Assisted Gravity Drainage (SAGD) is described in U.S. Pat. No. 4,344,485 (Butler) is used by many operators in heavy oil and bitumen reservoirs. In this method, two horizontal wells, drilled substantially parallel to each other, are positioned in the reservoir to recover hydrocarbons. The top well is the injection well and is located between 5 and 10 meters above the bottom well. The bottom well is the production well and typically located between 1 and 3 meters above the base of the oil reservoir. In the process, steam, injected through the top well, forms a vapour phase chamber that grows within the oil formation. The injected steam reaches the edges of the depletion chamber and delivers latent heat to the tar sand. The oil phase is heated and as a consequence its viscosity decreases and the oil drains under the action of gravity within and along the edges of the steam chamber towards the production well. In the initial stages of the process, the chamber grows vertically. After the chamber reaches the top of the reservoir, it grows laterally. The reservoir fluids, heated oil and condensate, enter the production wellbore and are motivated, either by natural pressure or by pump, to the surface. The thermal efficiency of SAGD is measured by the steam (expressed as cold water equivalent) to oil ratio (SOR), that is CWE m3 steam/m3 oil. Typically, a process is considered thermally efficient if its cumulative SOR is between 2 and 3 or lower. There are many published papers and portions of books and regulatory applications that describe the successful design and operation of SAGD. A literature review shows that while SAGD appears to be technically effective at producing heavy oil or bitumen from high quality connected reservoirs, there remains a continued need for well configurations and processes that improve the SOR of SAGD. Currently, the major capital and operating costs of SAGD are tied to the steam generation and water handling, treatment, and recycling facilities.

A variant of SAGD is the Steam and Gas Push (SAGP) process developed by Butler (Thermal Recovery of Oil and Bitumen, Gray-Drain Inc., Calgary, Alberta, 1997}, In SAGP, steam and non-condensable gas are co-injected into the reservoir, and the non-condensable gas forms an insulating layer at the top of the steam chamber. This lowers the heat losses to the cap-rock and improves the thermal efficiency of the recovery process. The well configuration is the same as the standard SAGD configuration.

Examples of literature on design and operation of SAGD in the field include: Butler (Thermal Recovery of Oil and Bitumen, Gray-Drain Inc., Calgary, Alberta, 1997), Komery et al. (Paper 1998.214, Seventh UNITAR International Conference, Beijing, China, 1998), Saltuklaroglu et al. (Paper 99-25, CSPG and Petroleum Society Joint Convention, Calgary, Canada, 1999), Butler et al. (J. Can. Pet. Tech., 39(1): 18, 2000). Examples of literature describing oil composition and viscosity gradients in heavy and bitumen reservoirs include: Larter et al. (2006), Head et al. (2003) and Larter et al. (2003).

There are other examples of processes that use steam or solvent with different well configurations to recover heavy oil and bitumen.

The literature contains many examples of in situ methods to recover heavy oil or bitumen economically yet there is still a need for more thermally-efficient and cost-effective in situ heavy oil or bitumen recovery technologies, especially when considering the vertical and areal variations of viscosity in the reservoir. There is disclosed herein a method to recover heavy oil or bitumen from a heterogeneous viscosity reservoir in a manner that is more cost-effective and thermally-efficient than existing methods.

FURTHER REFERENCES

Further references include:

Head, I. M., D. M. Jones, et al. (2003) Biological activity in the deep subsurface and the origin of heavy oil. *Nature* 426(6964): 344-352;

Huang, H. P., S. R. Larter, et al. (2004) A dynamic biodegradation model suggested by petroleum compositional gradients within reservoir columns from the Liaohe basin, NE China. *Organic Geochemistry* 35(3): 299-316;

Koopmans, M. P., S. R. Larter, et al. (2002) Biodegradation and mixing of crude oils in Eocene Es3 reservoirs of the Liaohe basin, northeastern China. *AAPG Bulletin* 86(10): 1833-1843;

Larter, S. R., J. J. Adams, I. D. Gates, B. Bennett, and H. P. Huang (2006) The origin, prediction and impact of oil viscosity heterogeneity on the production characteristics of tar sand and heavy oil reservoirs. *JCPT,* in review;

Larter, S. R., A. Wilhelms, et al. (2003) The controls on the composition of biodegraded oils in the deep subsurface—part 1: biodegradation reates in petroleum reservoirs. *Organic Geochemisty* 34(4): 601-613;

Gates, I. D., and Chakrabarty, N. Optimization of Steam-Assisted Gravity Drainage (SAGD) in Ideal McMurray Reservoir. Paper 2005-193 presented at Canadian International Petroleum Conference, Calgary, Alberta, Canada, Jun. 7-9, 2005;

Gates, I. D., Kenny, J., Hernandez-Hdez, I. L., and Bunio, G. L. Steam Injection Strategy and Energetics of Steam-Assisted Gravity Drainage. Paper SPE 97742 presented at the 2005 SPE International Thermal Operations and Heavy Oil Symposium held in Calgary, Alberta, Canada, 1-3 Nov. 2005a; and Donnelly, J. K. "The Best Process for Cold Lake CSS versus SAGD", CSPG and Pet. Soc. Joint Convention, Calgary, Alberta, Canada, 14-18 Jun. 1999.

SUMMARY

The present invention relates to a heavy oil or bitumen recovery method. It utilizes an inclined portion within the production well to extend the vapour chamber formation from the injector well. In combination with gravity assisted vapour stimulation processes, the well configuration is designed to enhance the production of heavy oil or bitumen from reservoirs. In one embodiment of the invention, only a portion of the production well is inclined in comparison to the injector well (as examples, H-Well or M-Well and Gravity Assisted Steam Stimulations or "HAGASS" or "MAGASS"). In another embodiment, the production well, inclined along its length (J-Well and Gravity Assisted Steam Stimulation or "JAGASS"), is placed below the injector well whereby the toe of the production well is closest to the injector toe, and the heel of the production well is positioned at a greater distance from the heel of the injector well. The method is applicable to any reservoir, but is especially beneficial in heavy oil and tar sand reservoirs.

The invention also relates to an improved process to recover heavy hydrocarbons from an underground reservoir which shows a vertical or lateral oil mobility gradient controlled by variations in oil viscosity. The method takes advantage of the common vertical changes in oil viscosity in heavy oil tar sand (HOTS) reservoirs and provides a route to initiate earlier production of HOTS petroleum and to ensure maximum vapour chamber growth along the full length of a horizontal vapour injector well.

BRIEF DESCRIPTION OF THE DRAWINGS

Embodiments of a heavy oil or bitumen recovery process will now be described by way of example only, with reference to the attached Figures, wherein:

FIG. 4*a-l* are embodiments of the inclined wells; FIG. 4*a-d* show side and end cross-sectional views of the JAGASS well configuration and process evolution at four different times respectively; FIGS. 4*e-h* show side cross-sectional views of the HAGASS well configuration where the production well is inclined at the toe end only; FIG. 4*i* shows the same embodiment as FIGS. 4*e-h* but with wells aligned in a linear arrangement; FIGS. 4*j-l* are side cross-sectional views of the MAGASS well configuration with an inclined portion in the middle of the production well. In this embodiment a pump would be necessary to produce fluids from the toe of the well;

FIG. 6*a* is a graph that compares the cSOR of standard SAGD and JAGASS processes as a function of time; FIGS. 6*b-d* compares the cSOR and thermal efficiency of the JAGASS well configuration to SAGD along the length of the wells.

DETAILED DESCRIPTION

With reference to the Figures, an inclined well and gravity assisted vapour stimulation process for recovery of in situ heavy oil or bitumen from reservoirs is described. The improved process and well configuration will be described with reference to SAGD recovery process. However, a person skilled in the art will understand that other gravity assisted stimulation processes can be used, including steam and solvent recovery processes.

To sustain mobile oil flow to the bottom of the steam chamber under the action of gravity, it is required to create and grow the vapour chamber in an oil reservoir. This produces the density difference between vapour and liquid phases which causes gravity-induced flow of liquid to the production well. The liquid is then removed from the chamber by the production well which delivers it to the surface. To continuously produce oil from the reservoir, the chamber must expand as the process evolves.

It should be noted that the cumulative volume of steam is expressed in terms of the volume of cold water required to produce the steam volume. The following description refers to the attached Figures.

Figure 1:
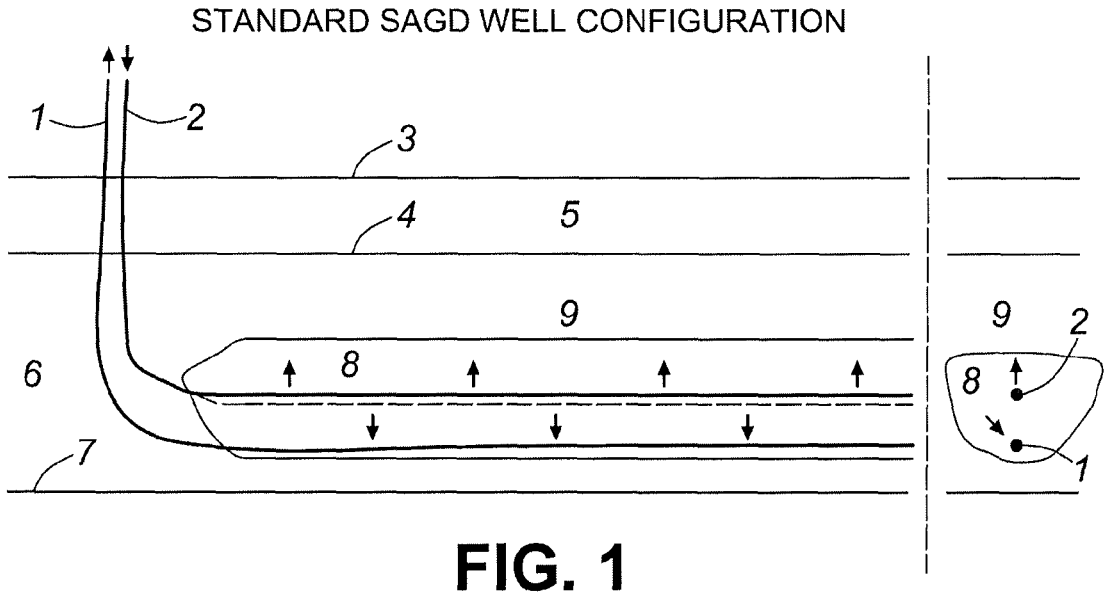
FIG. 1 (Prior Art)
FIG. 1 is a side and end view of a standard SAGD well configuration.

In standard SAGD, as shown in FIG. 1, a horizontal production well 1 is drilled into the oil reservoir 6 penetrating the surface of the earth 2 and overburden materials 5. The reservoir is bounded on the top and bottom by the surface 4, the bottom of the overburden, and by the surface 7, the top of the understrata. Above the oil reservoir is the overburden 5, which is of any one or more of shale, rock, sand layers, and aquifers. A horizontal injection well 2, typically aligned vertically between five and ten meters above the production well 1 is also drilled into the reservoir 6. In standard SAGD, steam is injected into the reservoir through the injection well 2 and flows into the steam depletion chamber 8. In substantially vapour form, steam flows to the edges of the chamber 8, condenses, and delivers its latent heat to the tar sand 9 within the reservoir unit. As reservoir fluids are produced to the surface with the production well 1, the steam chamber 8 expands further into the oil reservoir. The injected steam acts to deliver both heat and pressure to the reservoir. After the oil in the reservoir 8 is heated, its viscosity falls, it becomes more mobile, and it flows under gravity to the production well 1.

Figure 2:
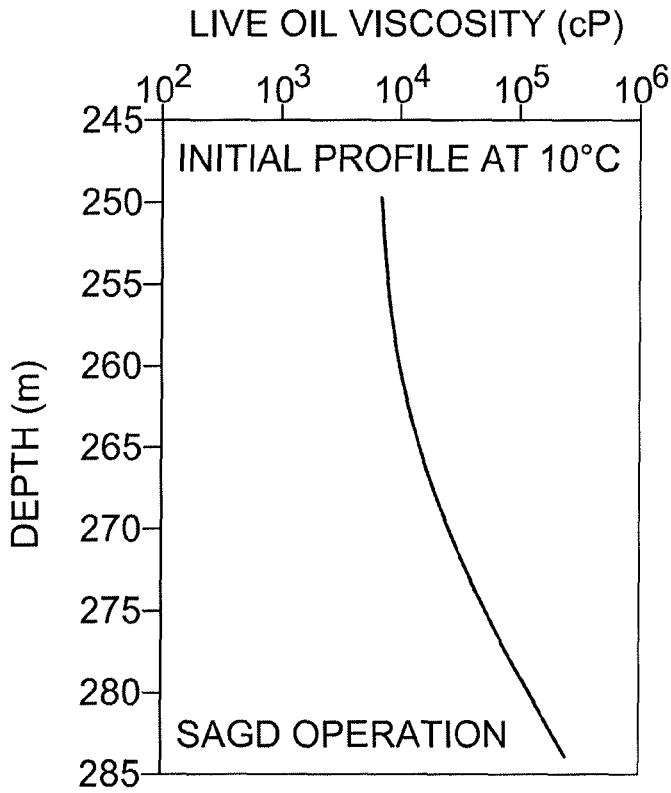
FIG. 2 displays a vertical viscosity profile for an Athabasca bitumen reservoir.
Figure 3:
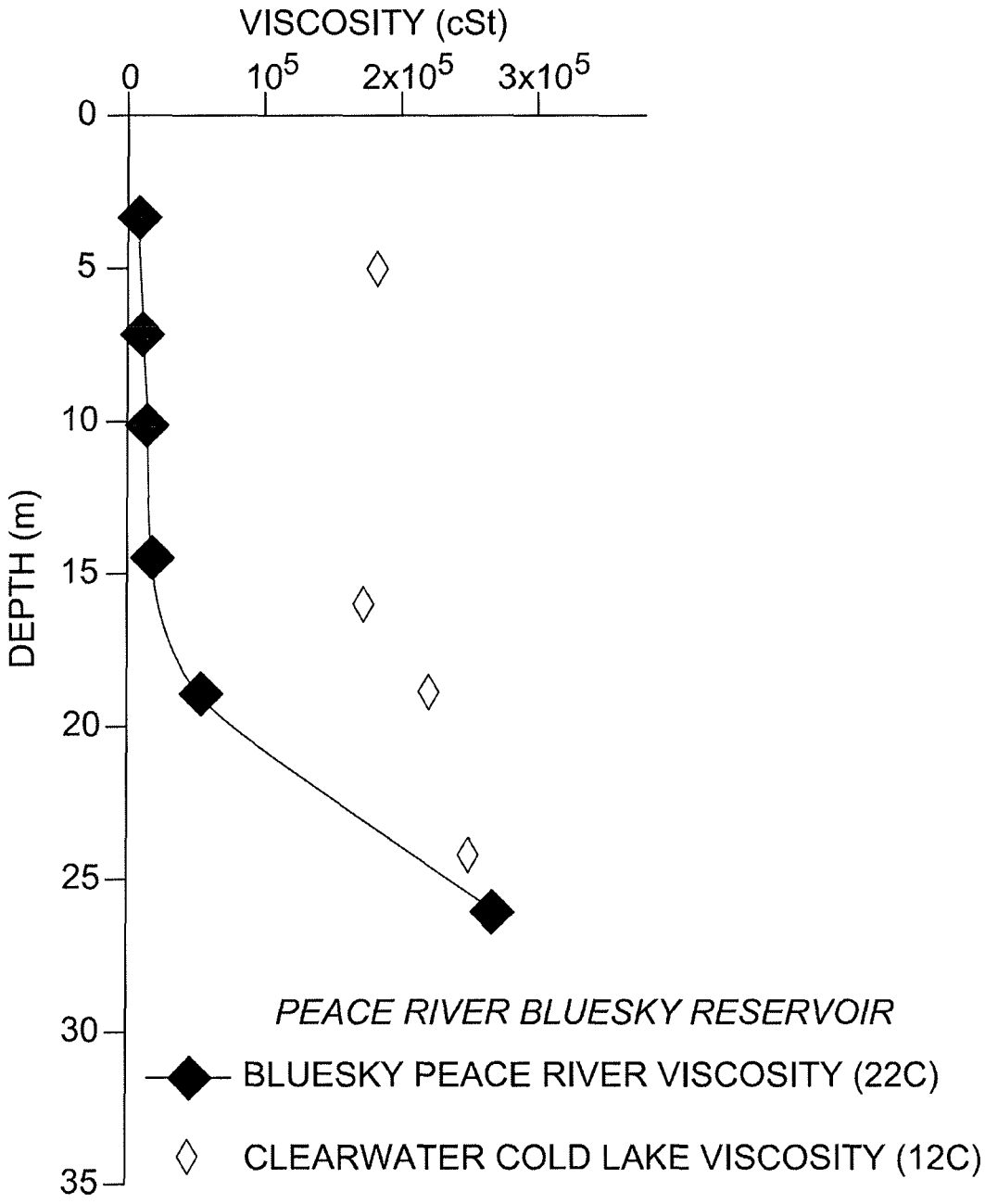
FIG. 3 shows a graph of a vertical viscosity profile for a Peace River tar sand reservoir.

In FIG. 2, a typical viscosity profile for an Athabasca bitumen reservoir is displayed. At the top of the oil-bearing formation, the live oil viscosity is roughly equal to 15,000 cP whereas at the bottom is it equal to about 250,000 cP at reservoir temperature. FIG. 3 shows a graph of the viscosity of the oil phase in Peace River tar sand with depth. Here, it varies from 10,000 cP at the top to 260,000 centipoise cP at the bottom at reservoir temperature. In FIG. 3, the viscosity of Cold Lake heavy oil with depth is plotted. FIGS. 2 and 3 show that viscosity variations in heavy oil and bitumen reservoirs can have order of magnitude differences between the value at the top and the value at the bottom of the reservoir.

As shown in FIGS. 4*a*, 4*b*, 4*c*, and 4*d*, a top horizontal well 11 is drilled into the reservoir 6 penetrating the surface of the earth 3 and the overburden 5. At the top and bottom of the reservoir are the bottom surface of the overburden 4 and top surface of the understrata 7. The horizontal well 11 lies in the reservoir 6, and has a heel and toe. A production well 10 lays in the reservoir 6 below the horizontal well 11 and has a heel and toe, with the toe higher than the heel in the reservoir so that the well is inclined. In some embodiments, the toes of the wells 10, 11 are closer to each other than the heels of the wells 10, 11. In some embodiments, the well 11 is mainly used as an injection well and is connected to surface injection equipment. In some embodiments, the well 10 is mainly used as a production well and is connected to surface production equipment.

Figure 4A:
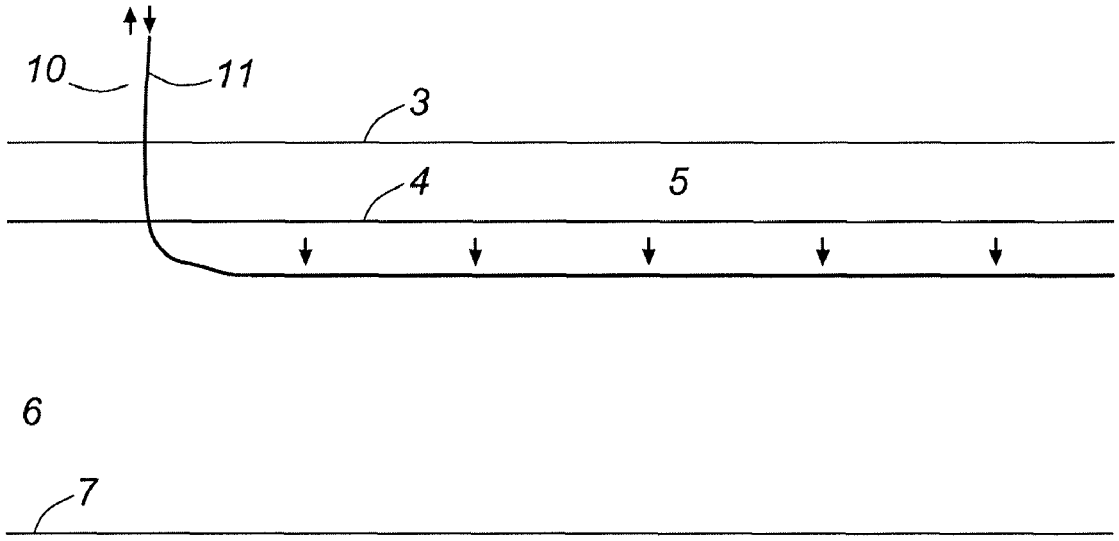

In one embodiment of the process, in a first stage (Stage 1) of the process, displayed in FIG. 4*a*, reservoir fluids are produced from the reservoir as is done in cold production of heavy oil and bitumen. In this stage of the process, no injectants are introduced into the reservoir 6. In this stage of production, between 1 and 20 volume % of the original hydrocarbon in place in the reservoir is produced depending on the economic benefit the process yields during its operation. In the second stage of the process (Stage 2), displayed in FIGS. 4*b*, 4*c*, and 4*d*, a second inclined well 10 is drilled into the oil formation in vertical alignment with the top horizontal well 11. Then, an injectant, acting as a hydrocarbon mobilizer, is injected into the oil reservoir through the top well 11 and reservoir fluids are produced through the bottom inclined well 10.

The injectant may be any suitable fluid that mobilizes hydrocarbons in the reservoir. In various embodiments, for example, the injectant may be water, steam, carbon dioxide, air, nitrogen or hydrocarbon solvent in the liquid or vapour phase. Suitable hydrocarbon solvents include $C_1$-$C_{10}$ alkanes, aromatics and alcohols. Combinations of these injectants may be used. In the case of air or a gas comprising, in some portion, oxygen being added as an injectant, a controlled burn of hydrocarbons created by igniting a flame front within the reservoir maybe be used to mobilize hydrocarbons. The injectant may operate by displacing reservoir hydrocarbons in a displacement mechanism, or by reducing the viscosity of the reservoir hydrocarbons so that they move by operation of gravity towards the production well 10. Viscosity reduction may be caused by heating, or by dissolution of the injectant in the reservoir hydrocarbons, or by solvent-induced precipitation or phase separation of the heavier components of the reservoir hydrocarbons leading to a more mobile lighter oil phase. Combinations of these mobilizing methods may be used, as for example using a heated solvent, with or without added displacement gas.

Figure 4B:
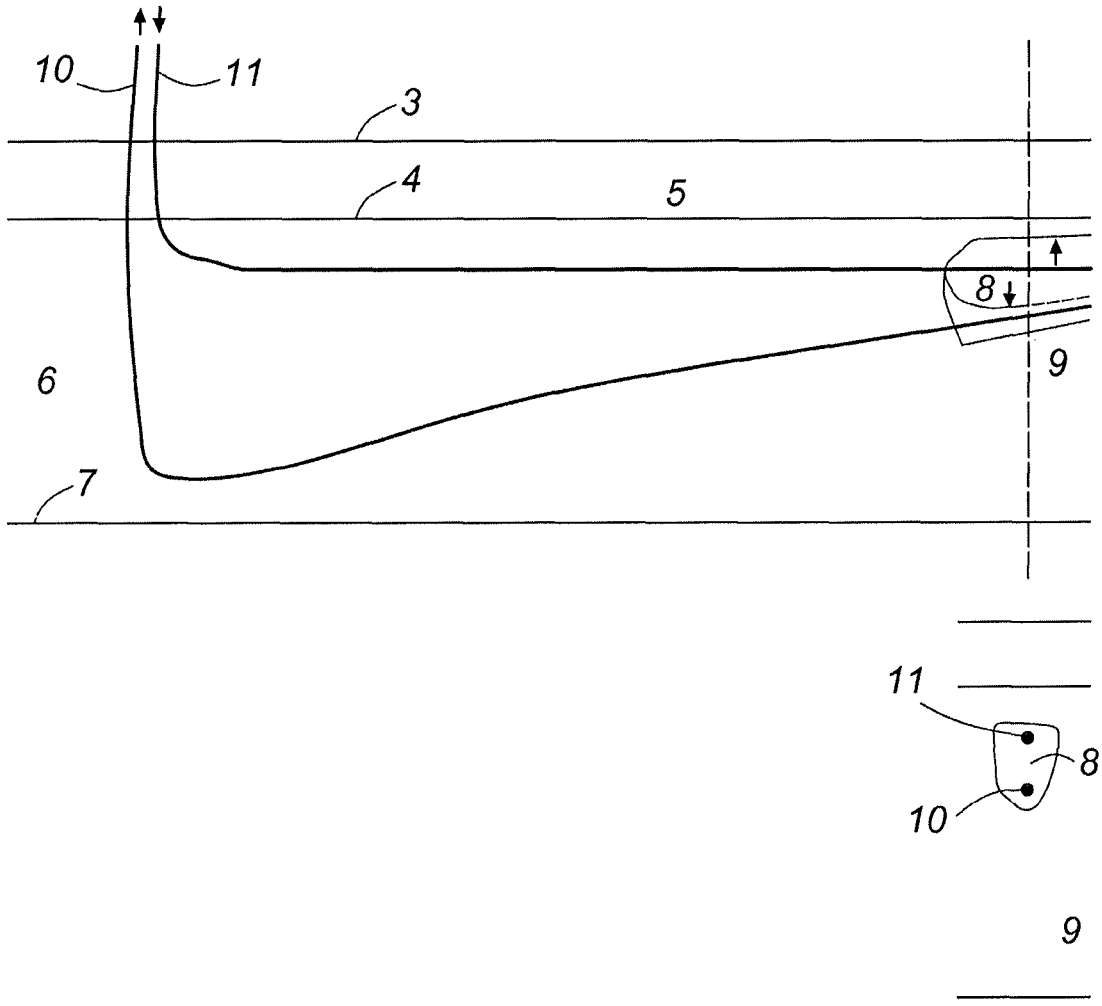

Prior to the start of production, it is desirable to establish a communication path between the top well 11 and the bottom well 10. This may be initially established by injection of injectant into either or both the top well 11 and bottom well 10, and should start at the toe, as illustrated in FIG. 4*b*. When steam is used as the injectant, a steam circulation interval may be used to establish thermal communication between the top and bottom wells. The steam provides a means to deliver energy and pressure to the reservoir. Steam circulation interval is the practice of passing hot steam through one or both of the injection and production wells to heat the formation materials immediately adjacent and surrounding the wells to sufficient temperature that the oil phase in this region has reduced viscosity and improved mobility. For example, the steam passes into the wells through a tubing string and is produced to the surface via the annular space between the tubing string and the well liner and casing. Typically, little steam is injected into the reservoir although some reservoir fluids may be produced due to thermal expansion of the reservoir fluids on heating.

Figure 4C:
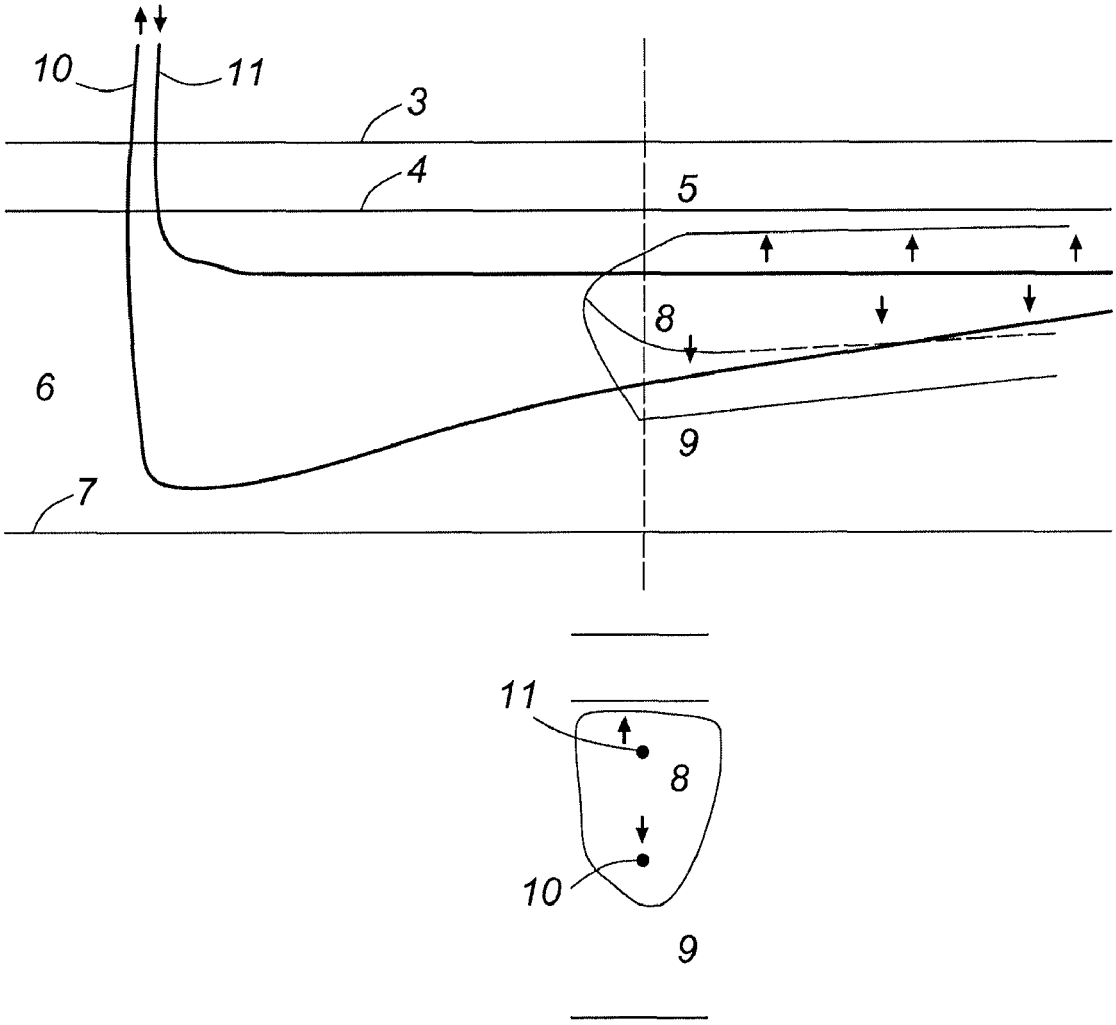
Figure 4D:
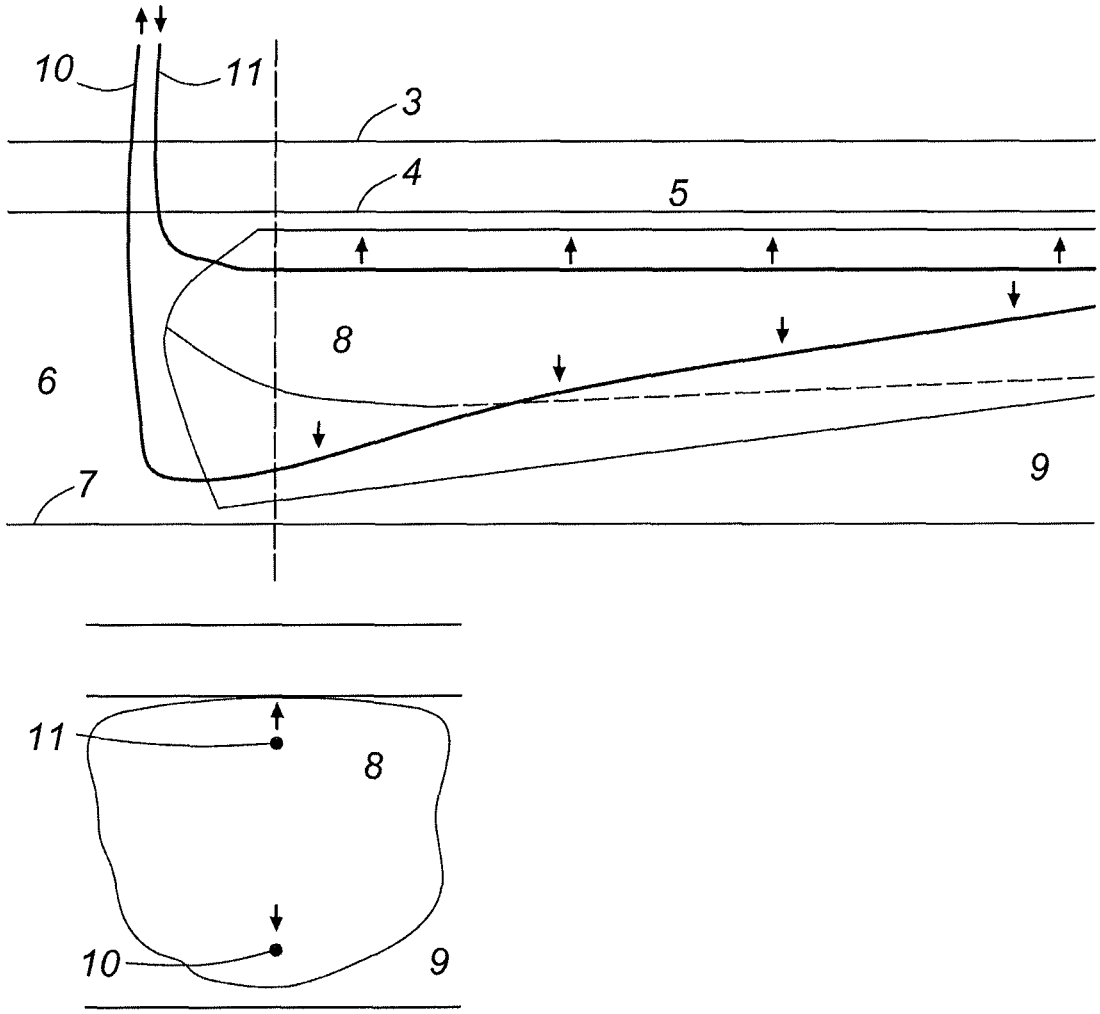
Figure 4E:
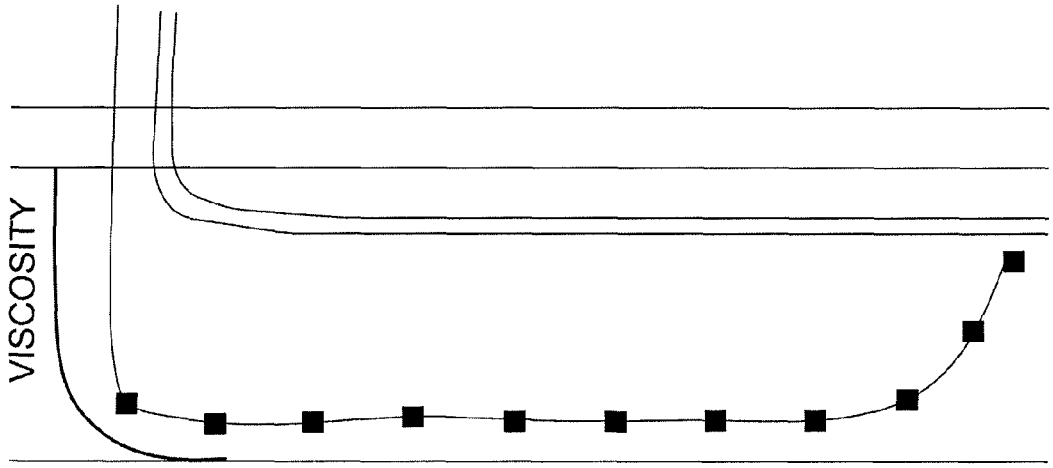
Figure 4F:
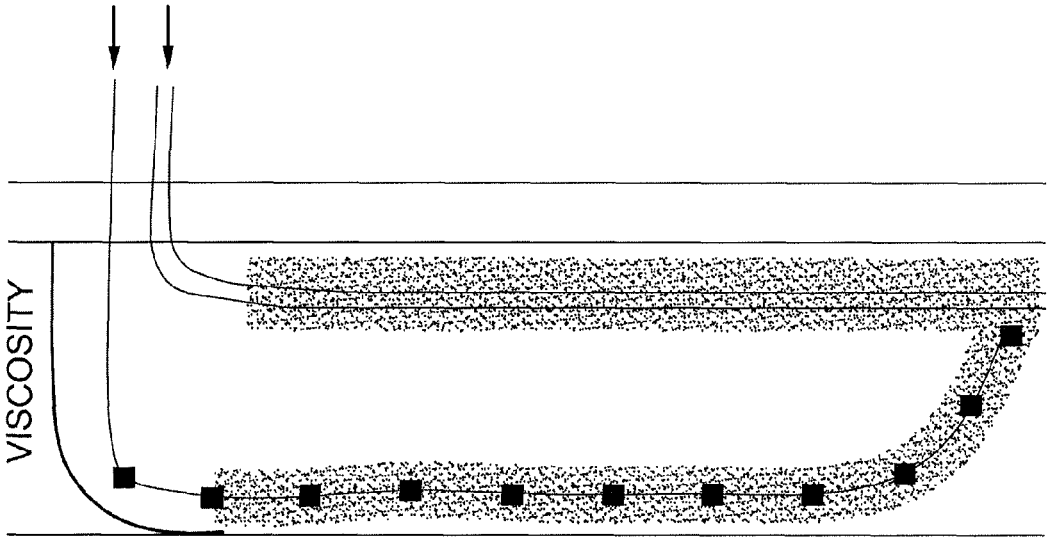
Figure 4G:
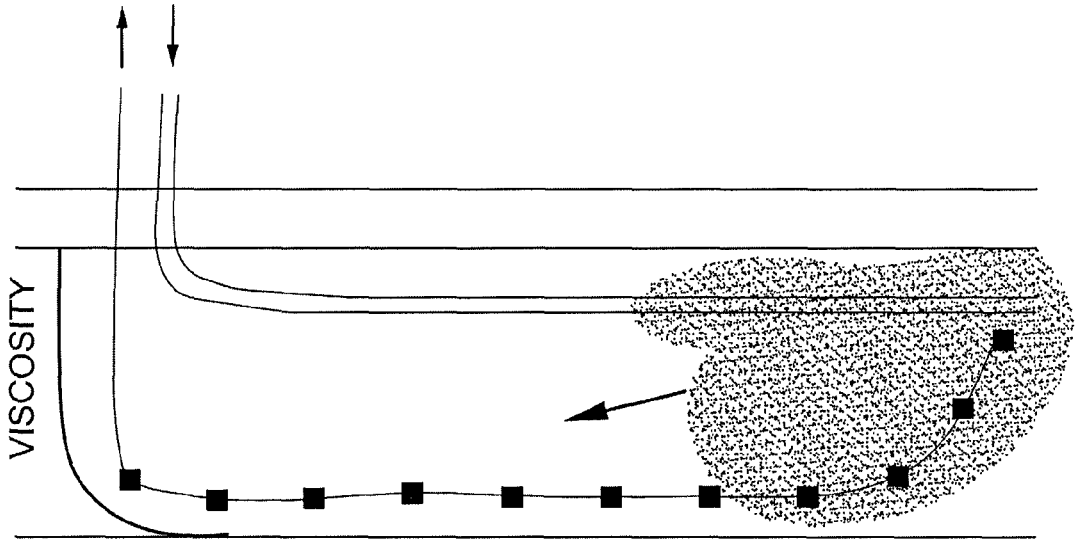
Figure 4H:
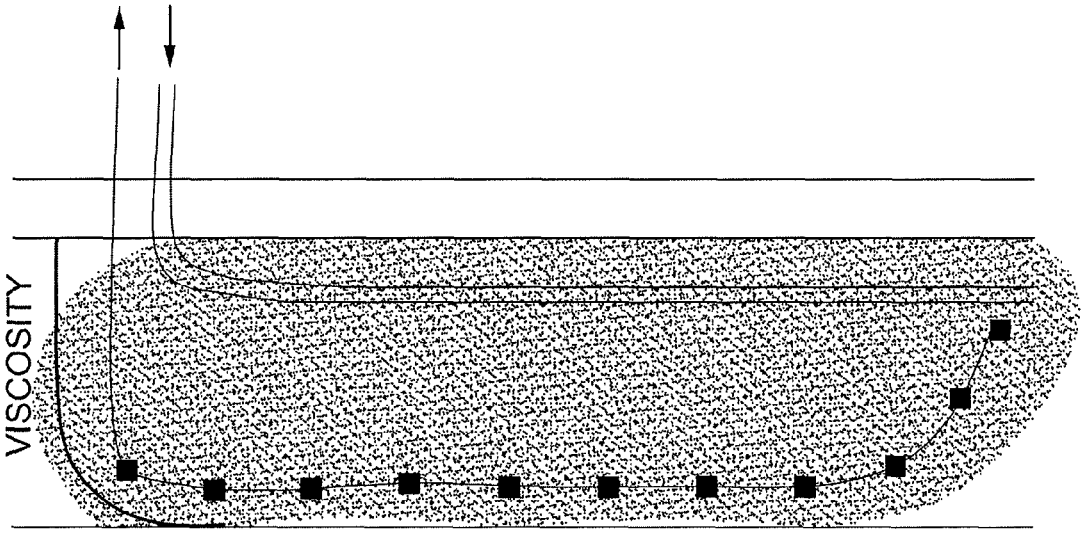

Injection of injectant into one or both of the wells 10, 11, creates a vapour and mobilized hydrocarbon chamber 8, which in one embodiment will start at the toes of the wells 10, 11. Injectant injected into the oil reservoir from well 11 flows to the edges of the chamber 8. In the case of steam used as an injectant, the steam condenses and releases its latent heat to the oil sand heating it and consequently lowering the oil phase viscosity enabling it to flow under the action of gravity to the production well 10. As the process evolves and oil is produced to the surface, as shown in FIGS. 4*b*, 4*c*, and 4*d*, the mobilized hydrocarbon chamber 8 expands into the reservoir 5 and along the wells 10 and 11 in the upwell direction.

As an alternate embodiment of the process, the process can be started from the second Stage alone, that is, without the cold production Stage. In this case, referring to FIG. 4*b*, the process will operate starting with the establishment of fluid communication between the top injection well 11 and bottom inclined production well 10. After communication is established, injectant is injected through the top well 11 into the chamber 8 and reservoir fluids are produced from the bottom well 10. Then the production process continues as shown in FIG. 4*c* and FIG. 4*d*.

After production is initiated, it can be maintained in some embodiments by continuing to inject injectant in a manner such that the mobilized hydrocarbon chamber 8 moves upwell. For example, in the case of steam, this may be accomplished using a modified SAGD procedure with a steam trap pressure control to prevent steam breakthrough or by injecting steam in the injector from a coiled tubing steam injector insert shown in FIG. 7 which allows the steam entry point to migrate back along the well bore during production as the chamber 8 develops. A similar technique, in which injectant is injected into the top well as a coiled tubing system is withdrawn from the well 11, may be used for continued production using other injectants.

Figure 7:
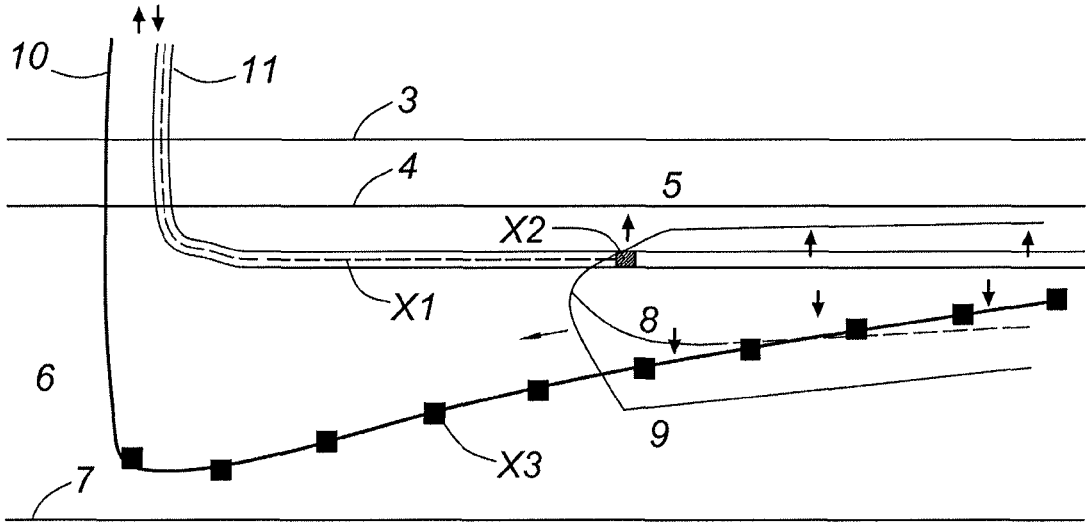
FIG. 7 shows injection of steam from a coiled tubing injector.

Steam trap control refers to the practice of controlling the production rate or production well pressure so that there is a liquid bath surrounding the production well. This prevents steam from passing directly from the injection well to the production well. FIG. 7 shows an embodiment of continued injectant injection using coiled tubing X1. The coiled 10 tubing X1 is inserted into the injection well with an injector insert X2 that has been partially withdrawn and lies approximately at the middle of the injection well 11. The insert can be as simple as the open end ofthe coiled tubing or may involve packers, valves or other devices to control flow. Sensors may be introduced to one or both the wells to detect the boundaries of the mobilized hydrocarbon chamber 8, and thus determine where and how much injectant to inject. In the case of use of steam as the injectant, steam breakthrough can be monitored using H and O stable isotopic signatures of water to facilitate real-time detailed control as well as from temperatures measured in the production well measured from thermocouples X3 placed along the production well. In an alternative embodiment, if the gas is used as an injectant, some gas, as for example steam, can be allowed to be produced into the production wellbore to have lift to promote reservoir fluids to be produced to the surface. One benefit is that the interwell communication would most likely occur at the toe (location of minimum interwell distance) which means that injectant will flow the length of the production well, increasing hydrocarbon mobility in and around the production well, and increasing production pressure. In the case of use of a heated injectant, the injectant will help to keep the production well at elevated temperature to enhance flow of the more viscous oils located in the lower parts of the reservoir along the wellbore.

Figure 4I:
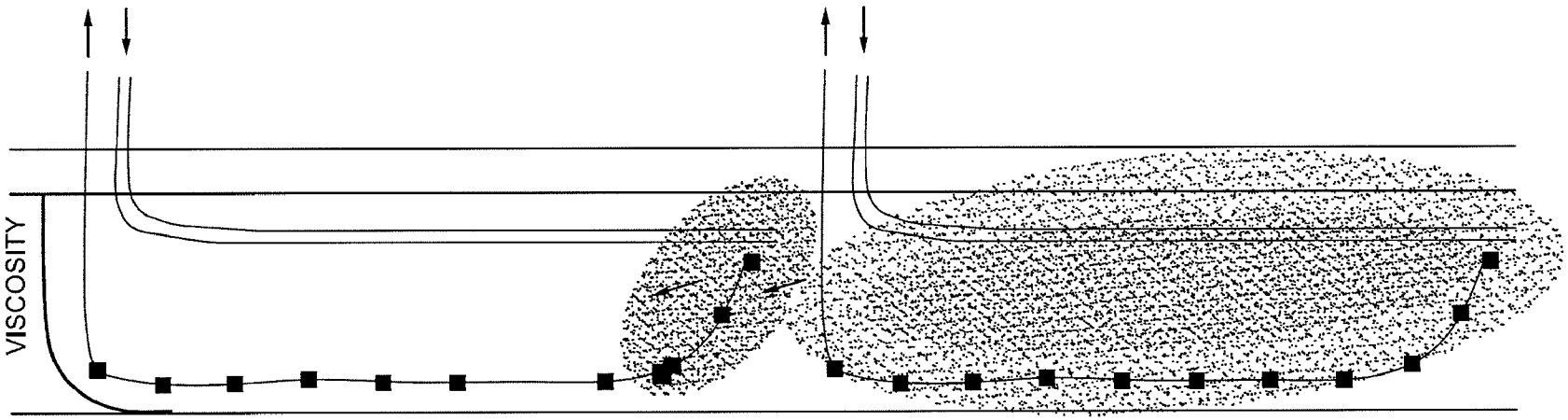
Figure 4J:
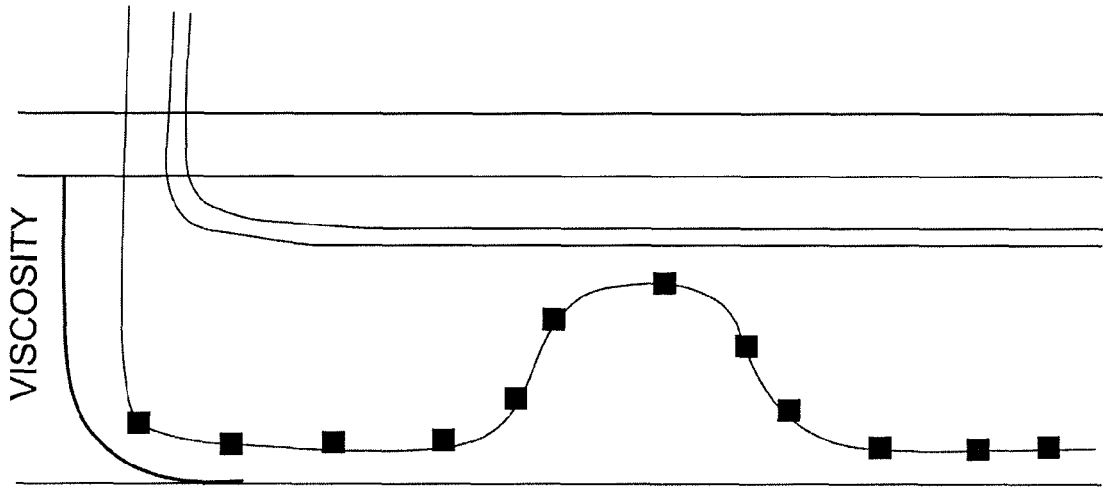
Figure 4K:
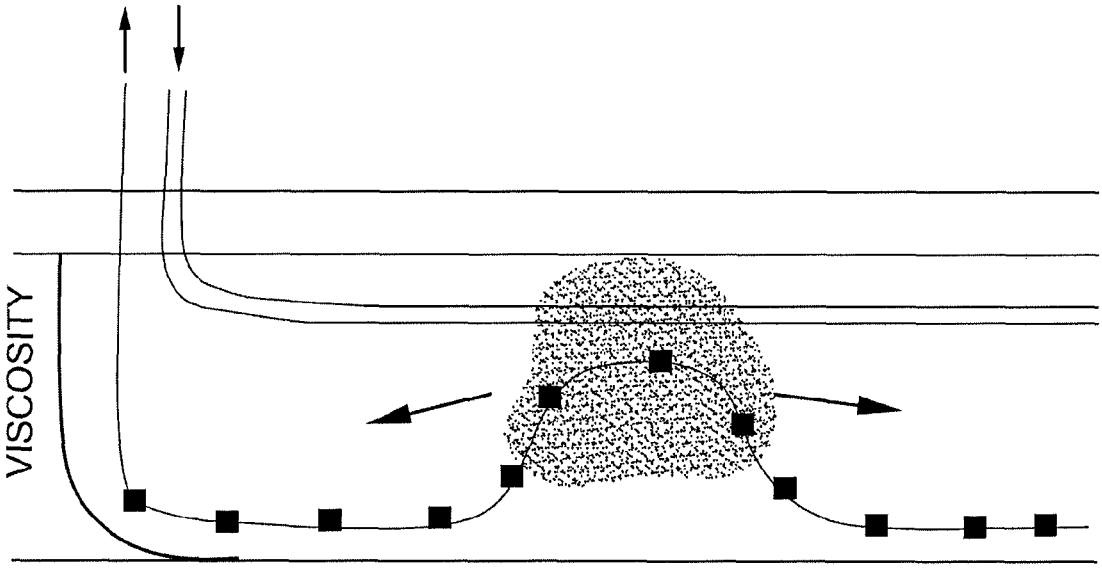
Figure 4I:
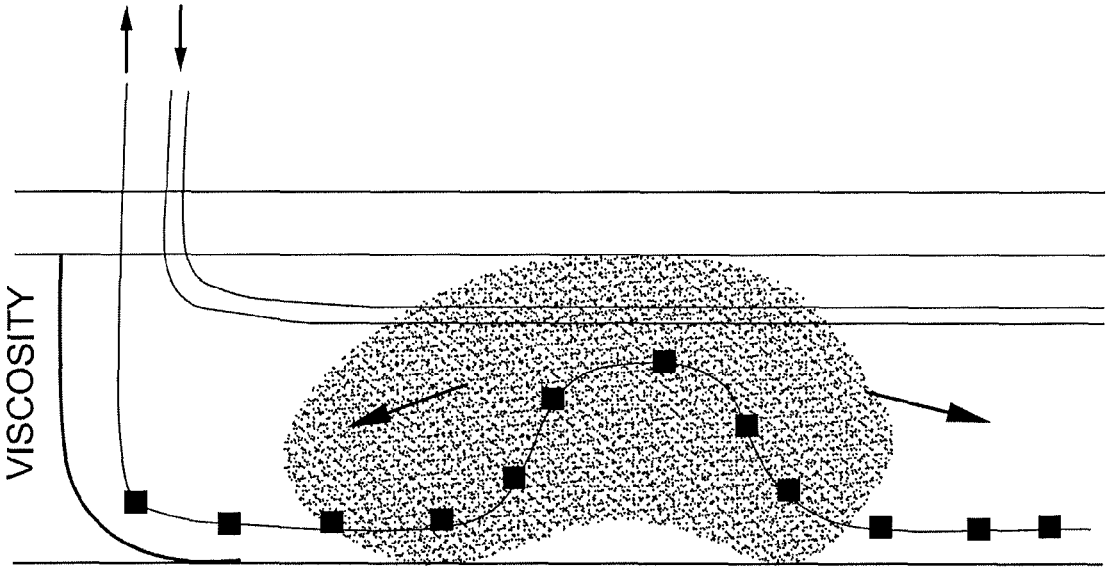

FIGS. 4*b*-*d* show a J-shaped production well with an incline along the entire length of the well. However, the production well does not need to be inclined along its entire length. For example, FIGS. 4*e-h* show a production well with an inclined section at the toe end (HAGASS). As shown, the vapour chamber forms at the toe of the wells and starts gravity drainage. The creation of the vapour chamber follows the incline and towards the heel of the well. As shown in FIG. 4*i*, a linear pattern of injection and production wells takes advantage of the vapour chamber formation and thermal efficiencies to increase production. Further, one injector well can be used for more than one production well to reduce the capital expenditures in oil recovery. FIGS. 4*j-l* show a further embodiment where the inclined portion occurs in the middle of the production well (MAGASS). In such a configuration, two production wells would be required.

Computer-aided reservoir simulation can be used to predict pressure, oil, solvent, water, and gas production rates, and vapour chamber 8 dimensions to help design the well placement and operating strategy. Also, the reservoir simulation calculations can be used to assist in the estimation of the time intervals of Stage 1 depicted in FIG. 4*a* (cold production) and Stage 2 displayed in FIGS. 4*b* to 4*d* (mobilized hydrocarbon drainage by using an inclined production well). Prior to executing the process in the field, a reservoir simulation study of the recovery process would be done to help plan the well configuration and operating strategy.

Figure 5:
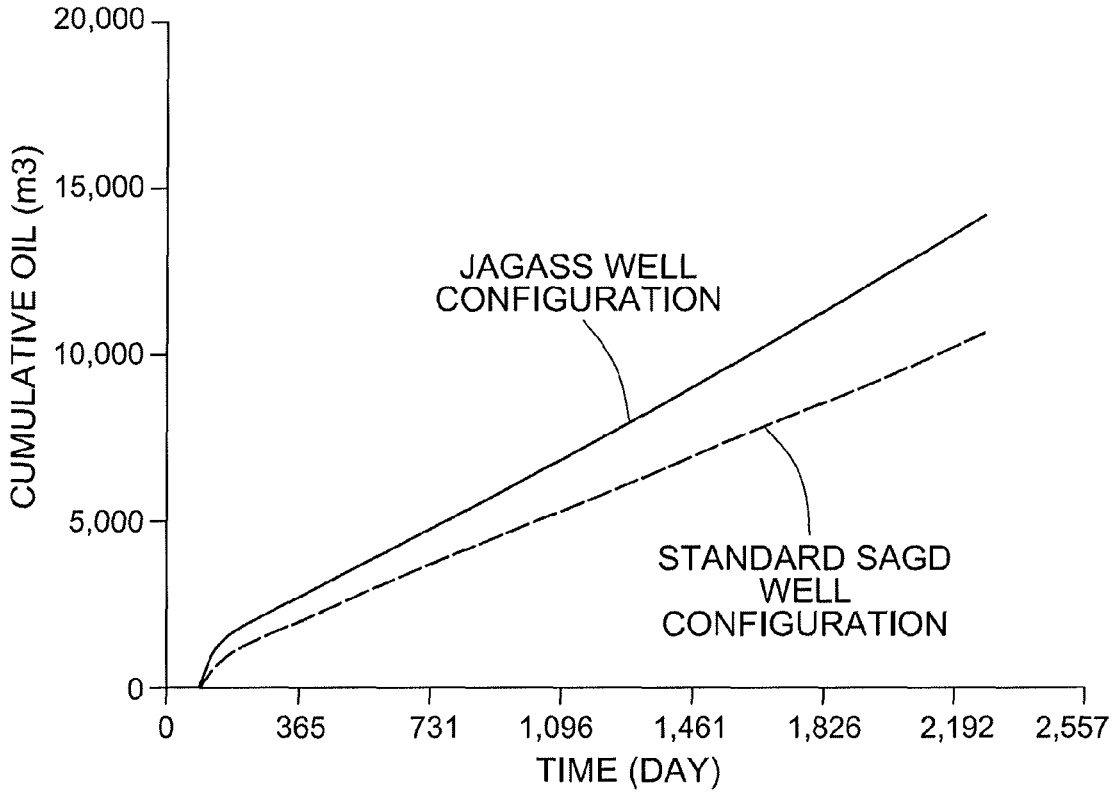
FIG. 5 is a graph of the performance of standard SAGD and the JAGASS processes as measured by the cumulative oil recovery as a function of time.

FIG. 5 compares the cumulative production of oil from field scale numerical model predictions in an Athabasca reservoir with vertical viscosity variations according to FIG. 2 between the standard SAGD and thermal JAGASS process (process where only Stage 2 as described above is done). The results reveal that the JAGASS process produces substantially more oil than the standard SAGD process.

Figure 6A:
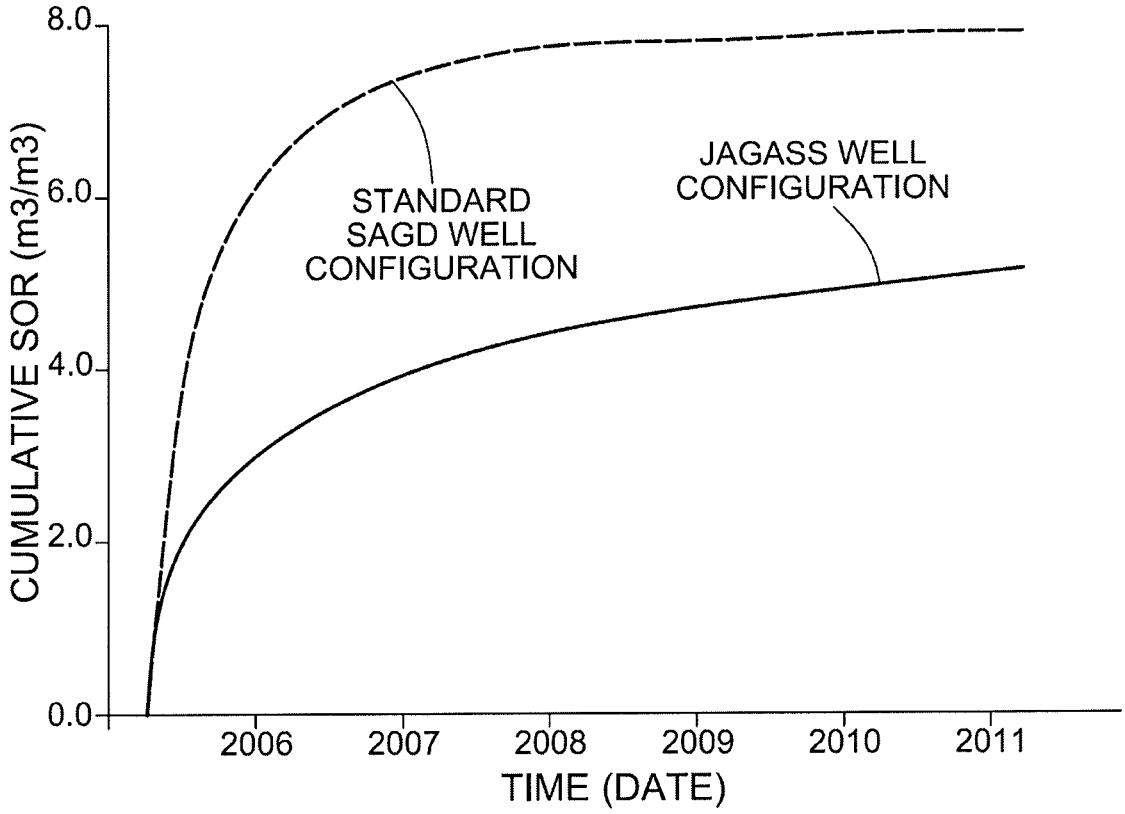
FIG. 6*a-d* show the cumulative steam to oil ratio (cSOR) and thermal efficiencies of the JAGASS embodiment and SAGD.
Figure 6B:
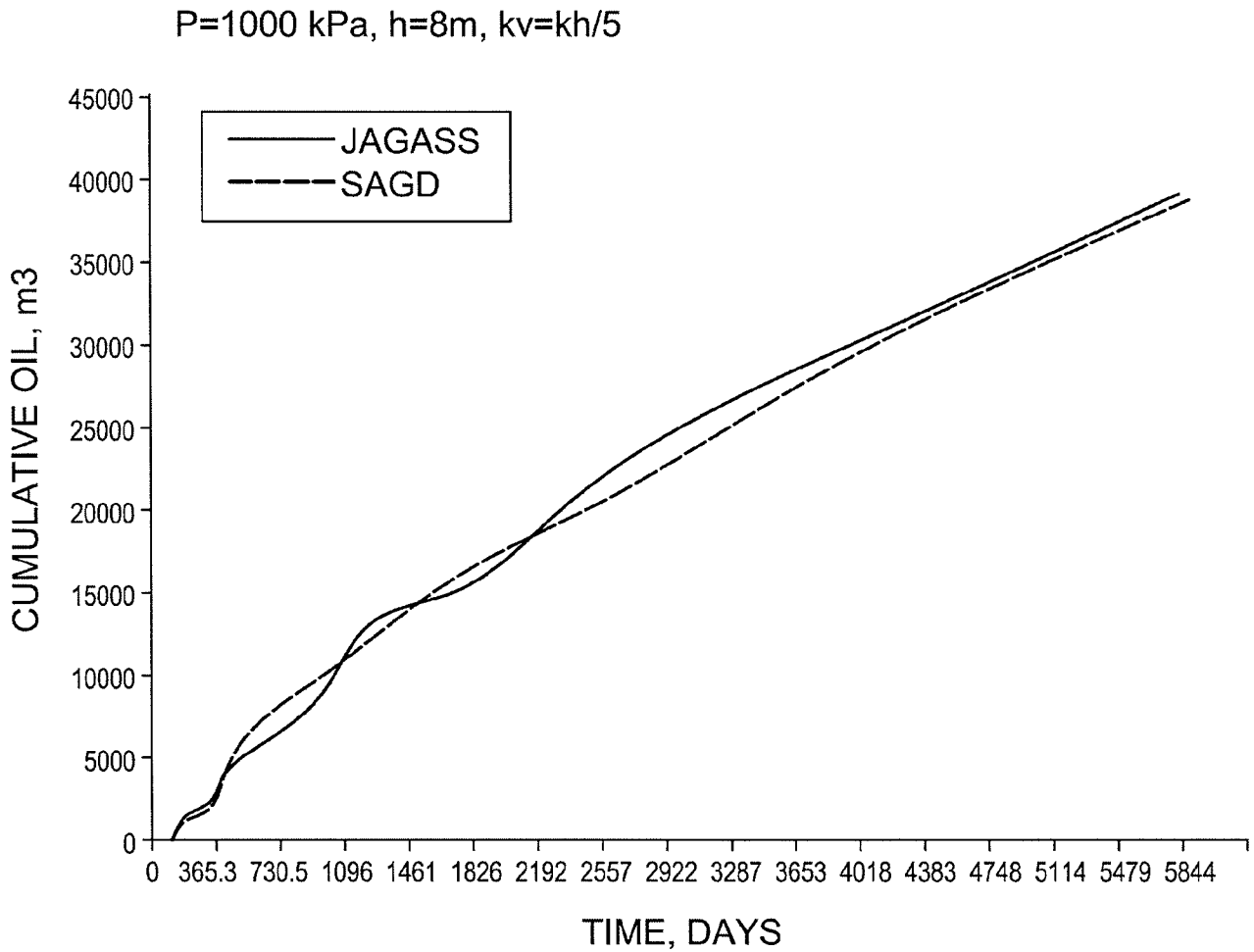
Figure 6C:
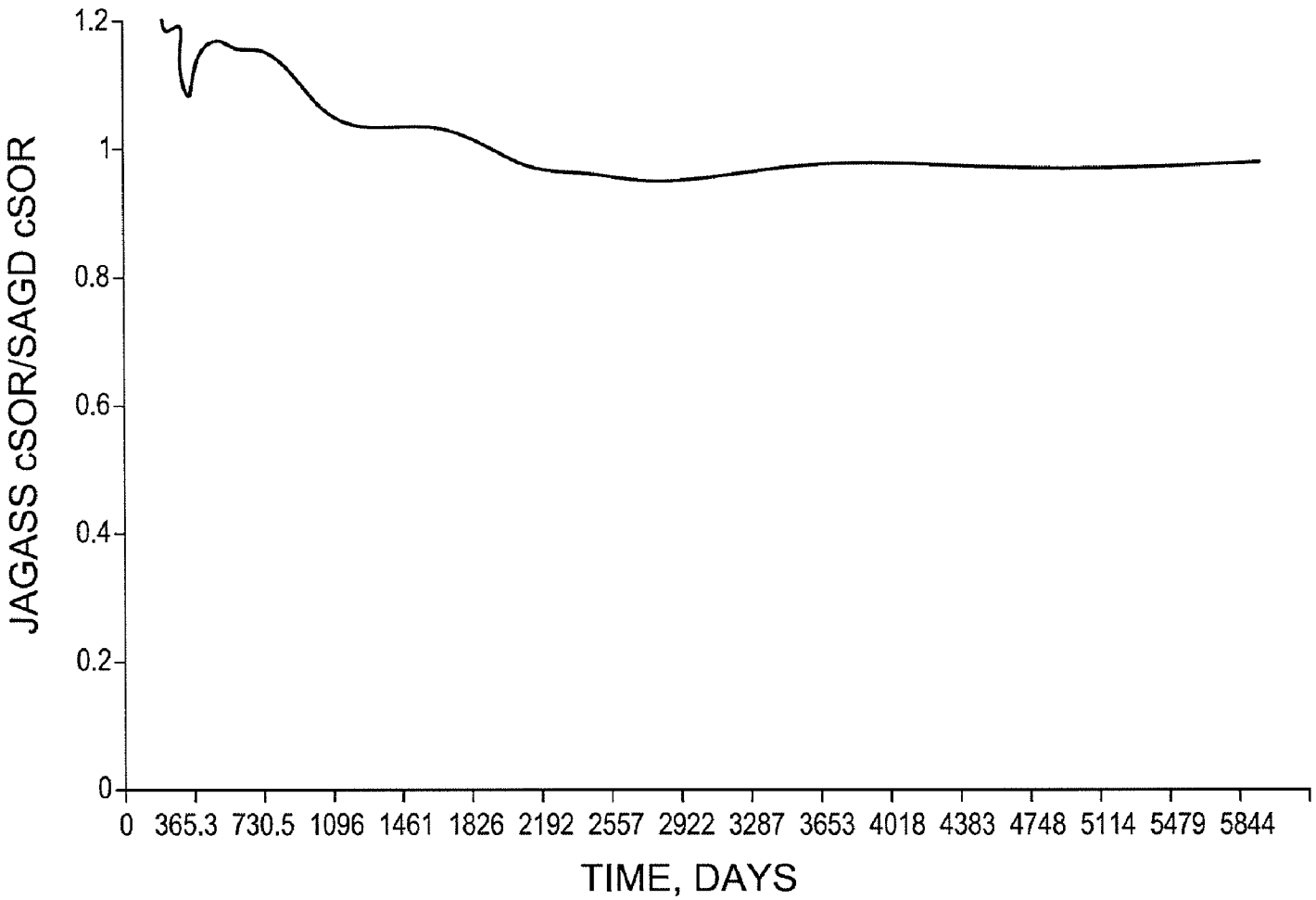
Figure 6D:
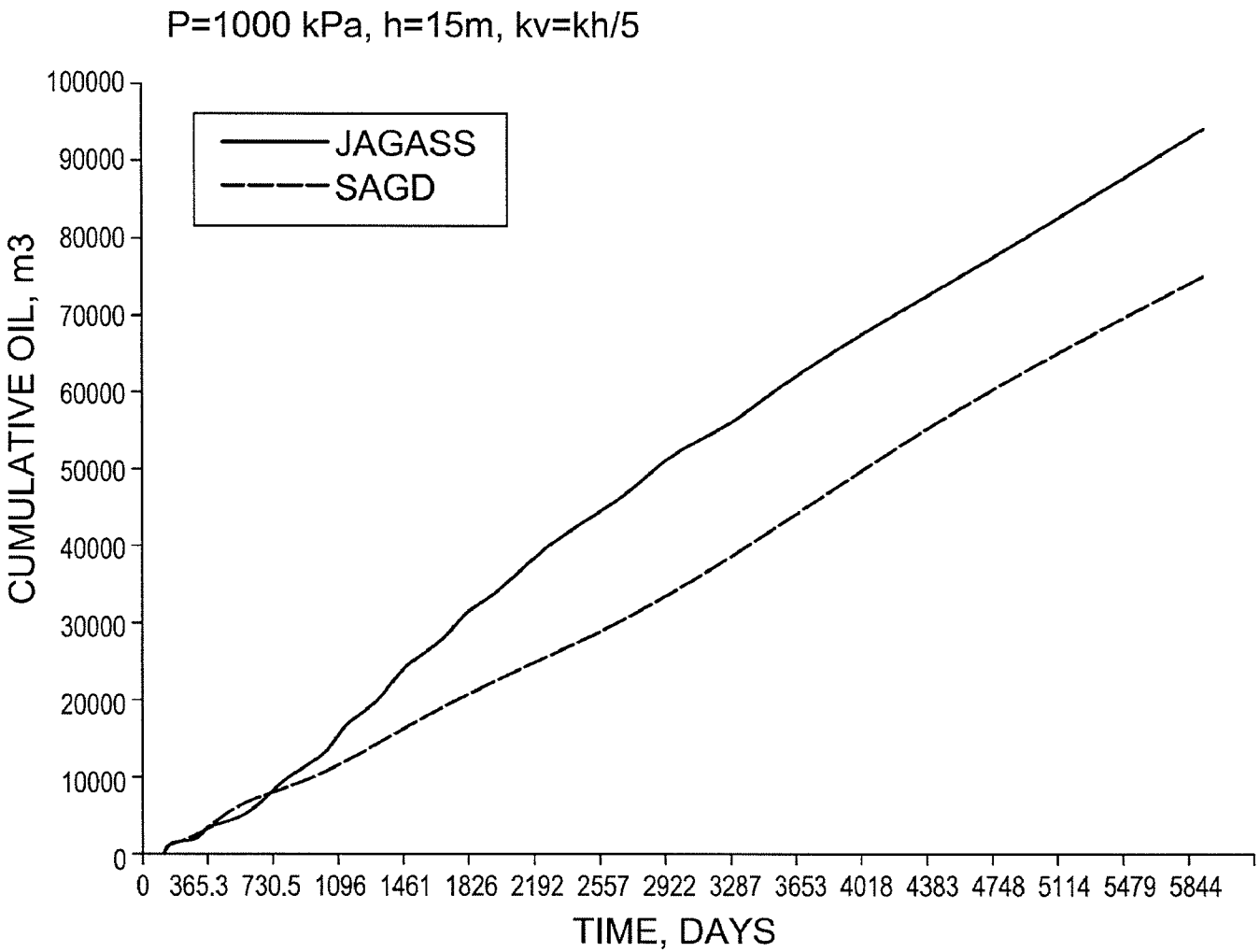

FIG. 6*a* displays the cumulative steam to oil ratio (cSOR) from field scale numerical model predictions of the standard SAGD and JAGASS processes. The cSOR is a measure of the thermal efficiency of the process and is closely correlated with the economic performance of the recovery processes. The results show that the JAGASS process is thermally more efficient than the standard SAGD process. FIGS. 6*b-d* show the cSOR and thermal efficiency of the JAGASS process along the length of the wells as compared to SAGD. These graphs show that the cSOR and thermal efficiency at the toes of the injector and production wells are the same for the J-well configuration as for SAGD. However, moving along the incline of the production well, as the distance between the wells increases, the cSOR and the thermal efficiency for the J-well is greater than that for SAGD.

In an alternative embodiment of the process, the injectant pressure and temperature can be changed throughout the operation of the process to improve the thermal efficiency of the process. For example, in the early stages of the process before the mobilized hydrocarbon chamber 8 has reached the top of the oil-rich interval, the injection pressure and corresponding saturation temperature could be high thus providing relatively high rates of oil production. Later, after the mobilized hydrocarbon chamber 8 has reached the top of the oil zone, the operating pressure and corresponding saturation temperature can be reduced so that heat losses to the overlying cap rock is reduced. This improves the overall thermal efficiency of the process. The pressure and temperature of the process can be measured by pressure sensors and thermocouples or other devices located in the injection or production wells or both as well as observation wells. Also, the pressure of the mobilized hydrocarbon chamber 8 can be estimated from the injection pressure at the injection well head by taking pressure losses in the well into account. A reduction of the pressure in the chamber can be obtained by 15 reducing the amount of injectant injected into the oil reservoir or by raising the production rate of fluids from the reservoir. An alternative method to lower the injectant partial pressure and corresponding injectant saturation temperature can be accomplished by adding an additive to the injected steam.

In an embodiment of the process, a steam additive can be added to injected steam to enhance the production rates of oil. A solvent, whether used in combination with other injectants or on its own, can lower the viscosity of the oil phase thus raising its mobility and therefore its production rate. A non-condensable gas additive for steam injection can also replace a fraction of the volume of steam injected into the reservoir thus raising the thermal efficiency of the process. Examples of solvent additives include the $C_2$ to $C_{10}$ hydrocarbons such as propane, hexane, or a mixture as would be the case with diluent or gas condensates. Examples of gases include methane, carbon dioxide, nitrogen, or air.

In an additional embodiment of the process, at the end of the process, a blowdown stage can be started in which no injectant is injected into the oil formation and the pressure of the mobilized hydrocarbon chamber is lowered while fluids are continuously produced to the surface. In this stage, because no injectant is being injected, the process is thermally very efficient (oil production with no injection). However, the oil rate declines rapidly because no additional heat is being injected into the reservoir and heat losses to the understrata and overburden start to consume the remaining heat in the oil zone.

In another embodiment of the present invention, the present process can be used to enhance recovery of heavy oil and bitumen from reservoirs that have vertical and/or areal viscosity gradients.

Compositional and fluid property gradients are common and documented in conventional heavy oilfields and in super heavy oil occurrences such as tar sand reservoirs. In the severely biodegraded oils of the Western Canadian tar sand reservoirs, highly non-linear chemical compositional and fluid viscosity gradients are common in both Athabasca and Peace River reservoirs (Larter et al., 2006). The variations in dead oil viscosity can be determined by mechanical recovery of the oil or bitumen with a centrifuge followed by measurements using a viscometer, or by solvent extraction and use of molecular composition and viscosity correlations. The molecular level variations in compositions are proxies for overall bitumen composition and thus viscosity, the actual compound suites most suitable to assess fluid properties varying with level of degradation and oil type. This is easily determined by using standard geochemical protocols and data analysis procedures that look for compound groups that show reproducible changes in composition over the viscosity range of application interest. Comparison of oil or bitumen molecular fingerprints from solvent extracted bitumens in reservoir core or cuttings, with similar sets of analyses on calibration sets of spun or otherwise extracted raw bitumen, allows for estimation of dead oil viscosities solely from the geochemical measurements and allow viscosity profiling of reservoirs to be carried out at meter scale resolution (Larter et al., 2006). These high resolution viscosity logs are essential for optimizing well locations in JAGASS and other thermal recovery processes using intelligent cold and thermal recovery techniques. This geochemical fluid property prediction approach allows for production of routine and rapid high resolution viscosity logs from core or cuttings or analysis of cuttings from horizontal wells. As heavy oil compositions commonly vary along well sections, the oil heterogeneity assessed from either core or cuttings, if appropriate samples are taken and stored, can also be used to allocate production to reservoir zones by using produced oil and multivariate deconvolution data analysis techniques. This is especially useful in allocation of production in horizontal wells and can be used to assess the effectiveness of the recovery well locations and to optimize well operations including steam and other injected fluid cycling sequences.

Dead oil viscosities are converted to live oil viscosities using gas solubility estimates as a function of reservoir pressure data and correlations between gas to oil ratio, live and dead oil viscosity. The dependence of oil viscosity on recovery temperature is determined by using measurements of viscosity on the same oil samples at various temperatures relevant to the recovery process. Thus, a profile through the oil column of viscosity as a function of temperature is obtained.

At in situ initial conditions i.e. temperature and pressure, heavy oil and bitumen have much higher viscosity than conventional light oils. Also, the defining characteristic of heavy and super heavy oilfields is the large spatial variation in fluid properties, such as oil viscosity, commonly seen within the reservoirs. Heavy oil and tar sands are formed by microbial degradation of conventional crude oils over geological timescales. Large-scale lateral and small-scale vertical variations in fluid properties due to interaction of biodegradation and charge mixing are common, with up to orders of magnitude variation in in-reservoir viscosity over the thickness of a reservoir. Constraints such as oil charge mixing, reservoir temperature-dependant biodegradation rate and aqueous nutrient supply to the organisms ultimately dictate the final distribution of viscosity found in heavy oil fields. Head et al. (2003); Larter et al. (2003; 2006); Huang et al. (2004).

The impact of viscosity variations in a heavy oil reservoir on heavy oil and bitumen productivity depends on the recovery method. Cold heavy oil production with sand (CHOPS) is critically influenced by oil viscosity and published literature (Larter et al., 2006) reveals that vertical viscosity gradients can substantially impact both existing steam assisted gravity drainage and cyclic steam stimulation operations if the gradients are not built into simulation protocol and well design procedures. (Larter et al., 2006).

Use of an inclined production well, as set out above, in combination the heavy oil or bitumen recovery method results in increased heavy oil or bitumen production. The inclined production well, or inclined portion of the production well, extends through the viscosity gradients within the reservoir. This allows for the earlier production of hydrocarbons and ensures maximum vapour chamber growth along the full length of the horizontal vapour injector well than with traditional methods.

The embodiments of the process described above are examples. A person skilled in this art understands that variations and modifications of the process can be done without departing from the scope of the claims. Such variations and modifications fall within the scope of the present invention.

The invention claimed is:

1. A method to recover heavy hydrocarbons from an underground reservoir, the method comprising the steps of:

a) providing a well, having a first heel and a first toe, located near the top of the reservoir in the oil formation where the oil phase viscosity at the top of the reservoir is lower than the oil phase viscosity deeper in the reservoir and producing reservoir hydrocarbons from the well under cold production conditions (non-thermal);

b) at a later time, drilling a lower inclined well in the reservoir at a position where the oil phase viscosity is higher than at the top well, having a second heel and a second toe, that has the second toe relatively close to the first toe of the top well and the second heel deeper in the oil formation below the first heel of the top well, c) injecting injectant into the top well and producing reservoir fluids from the lower inclined well; and d) continuing to inject injectant into the top well and producing reservoir fluids while growing a vapour and mobilized hydrocarbon chamber along the wellpair from the toes to the heels of the wells.

2. The method of claim 1 further comprising the step of circulating steam through the top and lower inclined wells to establish thermal communication between the two wells.

3. The method of claim 1 further comprising the step of monitoring and changing injection pressure to adjust the operating temperature of the process in steps a) through d).

4. The method of claim 1 further comprising the step of using combinations of injectants in steps a) through d).

5. The method of claim 1 further comprising a blowdown period where injection ceases and the pressure is reduced at the end of the economic life of the process to recover heavy oil or bitumen from the reservoir.

6. The method of claim 1 whereby the phase behaviour of the injectant is controlled by monitoring well pressures and temperatures in one or both of the wells.

7. The method of claim 6 wherein the injectant is steam and the phase behaviour of the injectant is controlled to maintain steam trap control such that liquid water covers the lower inclined well while a steam chamber surrounds the top well.

8. The method of claim 6 wherein the injectant is air and the reaction behaviour of the injectant with a small fraction of the reservoir hydrocarbons is controlled to obtain mobilized hydrocarbons.

9. The method of claim 8 wherein the reaction behaviour of the injectant with hydrocarbons in the reservoir comprises igniting a controlled hydrocarbon flame front within the reservoir.

10. The method of claim 1 wherein injectant is injected into the top well through coiled tubing that is pulled back through the top well.

11. The method of claim 10 wherein the coiled tubing is pulled back to follow the produced oil front.

12. The method of claim 10 wherein in-well control valves are used to control steam delivery in the top well.

13. A method to recover heavy hydrocarbons from an underground reservoir, the method comprising the steps of:

a) providing a well, having a first heel and a first toe, located near the top of the reservoir in the oil formation where the oil phase viscosity at the top of the reservoir is lower than the oil phase viscosity in the reservoir at a lower inclined well;

b) drilling the lower inclined well, having a second heel and a second toe, that has the second toe relatively close to the first toe of the top well and second heel deeper in the oil formation below the first heel of the top well, c) injecting injectant into the top well and producing reservoir fluids from the lower inclined well; and d) continuing to inject injectant into the top well and producing reservoir fluids while growing a vapour and mobilized hydrocarbon chamber along the well pair from the toes to the heels of the wells.

14. The method of claim 13 further comprising the step of circulating steam through the top and lower inclined wells to establish thermal communication between the two wells.

15. The method of claim 13 further comprising the step of monitoring and changing injection pressure to adjust the operating temperature of the process in steps a) through d).

16. The method of claim 13 further comprising the step of using combinations of injectants in steps a) through d).

17. The method of claim 13 further comprising a blowdown period where injection ceases and the pressure is reduced at the end of the economic life of the process to recover heavy oil or bitumen from the reservoir.

18. The method of claim 13 whereby the phase behaviour of the injectant is controlled by monitoring well pressures and temperatures in one or both of the wells.

19. The method of claim 18 wherein the injectant is steam and the phase behaviour of the injectant is controlled to maintain steam trap control such that liquid water covers the lower inclined well while a steam chamber surrounds the top well.

20. The method of claim 18 wherein the injectant is air and the reaction behaviour of the injectant with a small fraction of the reservoir hydrocarbons is controlled to obtain mobilized hydrocarbons.

21. The method of claim 20 wherein the reaction behaviour of the injectant with hydrocarbons in the reservoir comprises igniting a controlled hydrocarbon flame front within the reservoir.

22. The method of claim 13 wherein injectant is injected into the top well through coiled tubing that is pulled back through the top well.

23. The method of claim 22 wherein the coiled tubing is pulled back to follow the produced oil front.

24. The method of claim 22 wherein in-well control valves are used to control steam delivery in the top well.

25. A method to recover heavy hydrocarbons from an underground reservoir, wherein the underground reservoir has a top well located near the top of the reservoir in the oil-bearing formation, the method comprising the steps of:

a) providing a lower production well with an inclined portion having one end of the inclined portion relatively close to the top well and the other end of the inclined portion being deeper in the oil formation, b) injecting injectant into the top well and producing reservoir fluids from the lower production well; and c) continuing to inject injectant into the top well and producing reservoir fluids from the lower production well while growing a vapour and mobilized hydrocarbon chamber along the well pair from the toes to the heels of the wells.

26. The method of claim 25 further comprising the step of circulating steam through the top and lower wells to establish thermal communication between the two wells.

27. The method of claim 25 further comprising the step of monitoring and changing injection pressure to adjust the operating temperature of the process in steps a) through c).

28. The method of claim 25 further comprising the step of using combinations of injectants in steps a) through c).

29. The method of claim 25 further comprising a blowdown period where injection ceases and the pressure is reduced at the end of the economic life of the process in order to recover heavy oil or bitumen from the reservoir.

30. The method of claim 25 whereby the phase behaviour of the injectant is controlled by monitoring well pressures and temperatures in one or both of the wells.

31. The method of claim 30 wherein the injectant is steam and the phase behaviour of the injectant is controlled to maintain steam trap control such that liquid water covers the lower production well while a steam chamber surrounds the top well.

32. The method of claim 30 wherein the injectant is air and the reaction behaviour of the injectant with a small fraction of the reservoir hydrocarbons is controlled to obtained mobilized hydrocarbons.

33. The method of claim 32 wherein the reaction behaviour of the injectant with hydrocarbons in the reservoir comprises igniting a controlled hydrocarbon flame front within the reservoir.

34. The method of claim 25 wherein the injectant is injected into the top well through coiled tubing that is pulled back through the top well.

35. The method of claim 34 in which the coiled tubing is pulled back to follow the produced oil front.

36. The method of claim 34 in which in-well control valves are used to control steam delivery in the top well.

37. A method to recover heavy hydrocarbons from an underground reservoir, wherein the underground reservoir has a top well, having a first heel and a first toe, located near the top of the reservoir in the oil formation, the method comprising the steps of:

a) providing a lower inclined well, having a second heel and a second toe, with the second toe relatively close to the first toe of the top well and the second heel deeper in the oil formation below the first heel of the top well, b) injecting injectant into the top well and producing reservoir fluids from the lower inclined well; and c) continuing to inject injectant into the top well and producing reservoir fluids while growing a vapour and mobilized hydrocarbon chamber along the well pair from the toes to the heels of the wells.

38. The method of claim 37 further comprising the step of circulating steam through the top and lower wells to establish thermal communication between the two wells.

39. The method of claim 37 further comprising the step of monitoring and changing injection pressure to adjust the operating temperature of the process in steps a) through c).

40. The method of claim 37 further comprising the step of using combinations of injectants in steps a) through c).

41. The method of claim 37 further comprising a blowdown period where injection ceases and the pressure is reduced at the end of the economic life of the process in order to recover heavy oil or bitumen from the reservoir.

42. The method of claim 37 whereby the phase behaviour of the injectant is controlled by monitoring well pressures and temperatures in one or both of the wells.

43. The method of claim 42 wherein the injectant is steam and the phase behaviour of the injectant is controlled to maintain steam trap control such that liquid water covers the lower inclined well while a steam chamber surrounds the top well.

44. The method of claim 42 wherein the injectant is air and the reaction behaviour of the injectant with a small fraction of the reservoir hydrocarbons is controlled to obtained mobilized hydrocarbons.

45. The method of claim 44 wherein the reaction behaviour of the injectant with hydrocarbons in the reservoir comprises igniting a controlled hydrocarbon flame front within the reservoir.

46. The method of claim 37 wherein the injectant is injected into the top well through coiled tubing that is pulled back through the top well.

47. The method of claim 46 in which the coiled tubing is pulled back to follow the produced oil front.

48. The method of claim 46 in which in-well control valves are used to control steam delivery in the top well.

49. System for production of hydrocarbons from a reservoir, the system comprising:

an injector well lying in the reservoir;

a production well lying in the reservoir below the injector well;

wherein the injector well and the production well are separate wells; and wherein the injector well is in a reservoir area where the oil phase viscosity is lower than the oil phase viscosity of the reservoir area of the production well;

the production well having an inclined portion, the inclined portion having a top end and a lower end;

the top end of the inclined portion being closer to the injector well than the lower end of the inclined portion; wherein the production well is useful in gravity drainage production processes.

50. The system of claim 49 wherein the production well has a J-shape.

51. The system of claim 49 in which the injector well is connected to injection equipment and the production well is connected to production equipment.

52. System for production of hydrocarbons from a reservoir, the system comprising:

a first horizontal well lying in the reservoir, and having a first heel and a first toe;

a second horizontal well lying in the reservoir below the first horizontal well, the second horizontal well having a second heel and a second toe;

wherein the first and second horizontal wells are separate wells, and wherein the first horizontal well is in a reservoir area where the oil phase viscosity is lower than the oil phase viscosity of the reservoir area of the second horizontal well; and the second toe being higher in the reservoir than the second heel.

53. The system of claim 52 wherein the first toe is closer to the second toe than the first heel is to the second heel.

54. The system of claim 52 in which the first horizontal well is connected to injection equipment and the second horizontal well is connected to production equipment.

* * * * *

UNITED STATES PATENT AND TRADEMARK OFFICE

CERTIFICATE OF CORRECTION

PATENT NO. : 8,056,624 B2
APPLICATION NO. : 12/374927
DATED : November 15, 2011
INVENTOR(S) : Ian Donald Gates It is certified that error appears in the above-identified patent and that said Letters Patent is hereby corrected as shown below:

In title page, item (73) Assignee, lines 1-2, delete "CA (US)" and insert -- (CA) -- therefor as the country of location of the Assignee.

Signed and Sealed this
Thirty-first Day of January, 2012

David J. Kappos

David J. Kappos
*Director of the United States Patent and Trademark Office*